US008216003B2

(12) United States Patent
Fujimoto et al.

(10) Patent No.: US 8,216,003 B2
(45) Date of Patent: Jul. 10, 2012

(54) TERMINAL DEVICE HAVING A SUPPORT SURFACE PERPENDICULAR TO A CONTACT SURFACE

(75) Inventors: Kosuke Fujimoto, Kitakyushu (JP); Katsushige Nishimura, Kitakyushu (JP); Ryuichi Matsuzuka, Kitakyushu (JP)

(73) Assignee: Kabushiki Kaisha Yaskawa Denki, Fukuoka (JP)

( * ) Notice: Subject to any disclaimer, the term of this patent is extended or adjusted under 35 U.S.C. 154(b) by 0 days.

(21) Appl. No.: 13/027,152

(22) Filed: Feb. 14, 2011

(65) Prior Publication Data

US 2011/0287672 A1 Nov. 24, 2011

(30) Foreign Application Priority Data

May 20, 2010 (JP) ..... 2010-116300

(51) Int. Cl.
*H01R 9/22* (2006.01)

(52) U.S. Cl. ..... 439/709

(58) Field of Classification Search ..... 439/709, 439/71, 812–814
See application file for complete search history.

(56) References Cited

U.S. PATENT DOCUMENTS

| | | | | |
|---|---|---|---|---|
| 5,713,766 | A * | 2/1998 | Davies et al. | 439/709 |
| 6,981,901 | B2 * | 1/2006 | Takaya | 439/812 |
| 7,134,922 | B2 * | 11/2006 | Kim | 439/814 |
| 2006/0128232 | A1 * | 6/2006 | Kim | 439/813 |
| 2008/0218012 | A1 * | 9/2008 | Rogner et al. | 310/71 |

FOREIGN PATENT DOCUMENTS

JP 2004-022405 1/2004

* cited by examiner

*Primary Examiner* — Chandrika Prasad
(74) *Attorney, Agent, or Firm* — Ditthavong Mori & Steiner, P.C.

(57) ABSTRACT

An electronic apparatus includes a terminal holding mechanism that holds a terminal portion configured to conduct power from an external terminal, a terminal base that forms a part of the terminal holding mechanism, a partition wall having an open portion on a side, the partition wall separating the terminal portion and the terminal base, and a contact surface facing the open portion of the partition wall and provided integrally with the terminal base, the contact surface being electrically connected to the terminal holding mechanism.

8 Claims, 5 Drawing Sheets

TERMINAL DEVICE HAVING A SUPPORT SURFACE PERPENDICULAR TO A CONTACT SURFACE

CROSS-REFERENCE TO RELATED APPLICATION

The present application claims priority under 35 U.S.C. §119 to Japanese Patent Application No. 2010-116300, filed May 20, 2010. The contents of this application are incorporated herein by reference in their entirety.

BACKGROUND OF THE INVENTION

1. Field of the Invention

The present invention relates to a terminal device, an electronic apparatus, and an electronic apparatus production method.

2. Description of the Related Art

Japanese Patent Laid-Open Publication No. 2004-022405 discloses a terminal device (terminal base) that allows power or the like to be input to and output from an electronic apparatus such as an inverter. In the disclosed terminal device, a plurality of terminal screws are arranged side by side and are each surrounded by an insulating material (terminal base body).

In this terminal device, a connecting wire is connected to the electronic apparatus by fastening the corresponding terminal screw in a state in which a U-shaped terminal or a round terminal of the connecting wire is clamped between the terminal screw and a base of the terminal screw.

SUMMARY OF THE INVENTION

A terminal device according to an aspect of the present invention includes a terminal holding mechanism that holds a terminal portion configured to conduct power from an external terminal; a terminal base that forms a part of the terminal holding mechanism; a partition wall having an open portion on a side, the partition wall separating the terminal portion and the terminal base; and a flat contact surface facing the open portion of the partition wall and provided integrally with the terminal base, the contact surface being electrically connected to the terminal holding mechanism.

A terminal device according to another aspect of the present invention includes a terminal screw formed of a conductive material; and a terminal base including a support surface having a screw hole with a thread groove corresponding to the terminal screw and a contact surface bent from the support surface.

An electronic apparatus according to a further aspect of the present invention includes an electronic apparatus body having an electric circuit; and a terminal device provided in the electronic apparatus body. The terminal device includes a terminal holding mechanism that holds a terminal portion configured to conduct power from an external terminal, a terminal base that forms a part of the terminal holding mechanism, a partition wall having an open portion on a side, the partition wall separating the terminal portion and the terminal base, and a contact surface facing the open portion of the partition wall and provided integrally with the terminal base, the contact surface being electrically connected to the terminal holding mechanism.

An electronic apparatus according to a further aspect of the present invention includes an electronic apparatus body having an electric circuit; and a terminal device provided in the electronic apparatus body. The terminal device includes a terminal screw formed of a conductive material, and a terminal base including a support surface having a screw hole with a thread groove corresponding to the terminal screw and a contact surface bent from the support surface.

An electronic apparatus production method according to a still further aspect of the present invention includes the steps of assembling, in an electronic apparatus body, a terminal device including a terminal holding mechanism that holds a terminal portion configured to conduct power from an external terminal, a terminal base that forms a part of the terminal holding mechanism, a partition wall having an open portion on a side, the partition wall separating the terminal portion and the terminal base, and a flat contact surface facing the open portion of the partition wall and provided integrally with the terminal base, the contact surface being electrically connected to the terminal holding mechanism; conducting a product test on the electronic apparatus body while contacting a power supply pin with the contact surface of the terminal base through the open portion of the terminal device; and mounting an upper case that covers the electronic apparatus body after the product test.

An electronic apparatus production method according to an even further aspect of the present invention includes the steps of assembling, in an electronic apparatus body, a terminal device including a terminal screw formed of a conductive material, and a terminal base including a support surface having a screw hole with a thread groove corresponding to the terminal screw and a contact surface bent from the support surface; conducting a product test on the electronic apparatus body while contacting a power supply pin with the contact surface from a side; and mounting an upper case that covers the electronic apparatus body after the product test.

BRIEF DESCRIPTION OF THE DRAWINGS

The present invention will be described in further detail with reference to the accompanying drawings wherein.

DETAILED DESCRIPTION OF THE EMBODIMENTS

An embodiment of the present invention will be described below with reference to the drawings.

In the embodiment, the present invention is applied to a production line 50 for an inverter 32 serving as an example of an electronic apparatus. The inverter 32 receives an alternating current and outputs another alternating current having different voltage and frequency.

Figure 1:
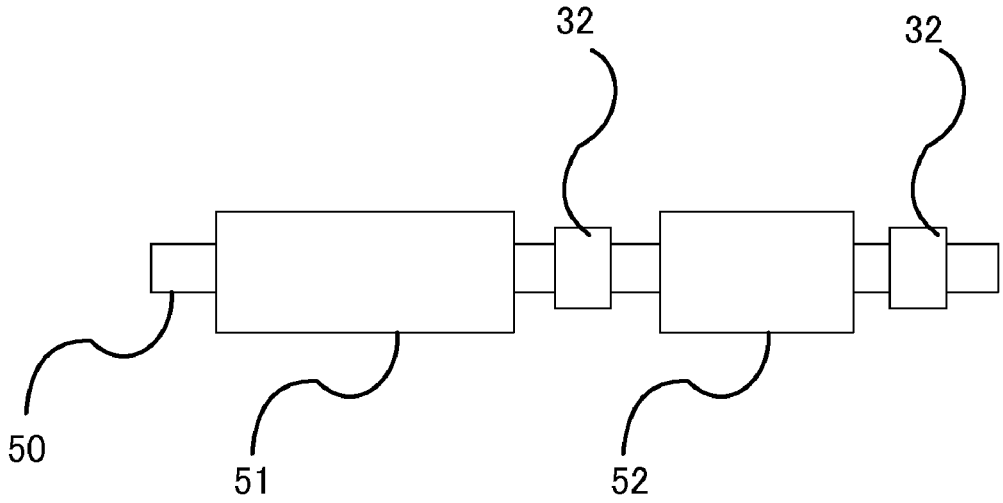
FIG. 1 schematically illustrates a production line for an electronic apparatus.

As illustrated in FIG. 1, the production line 50 for the inverter 32 includes a production section 51 and a product test section 52. In the production line 50, an inverter 32 assembled in the production section 51 is transported by a conveyor to the product test section 52 and downstream sections.

In the production section 51, assembly components are assembled into an inverter 32 serving as a product. In the product test section 52, various tests, such as a product test, are conducted on the inverter 32 assembled in the production section 51.

Next, a description will be given of a structure of the inverter 32 assembled in the production section 51.

Figure 2:
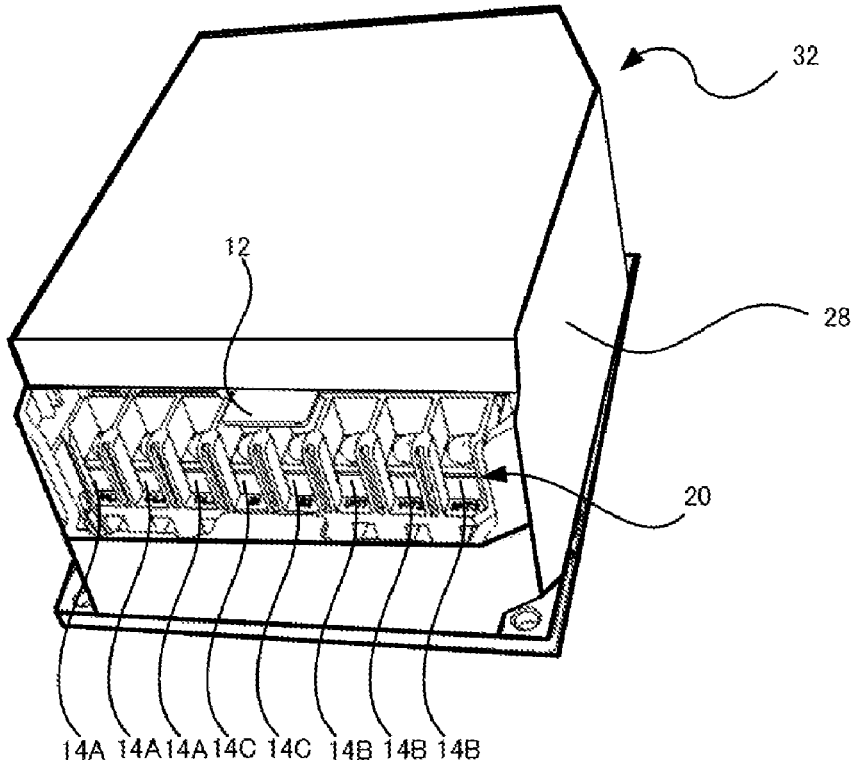
FIG. 2 illustrates an inverter including terminal bases according to the present invention.

As illustrated in FIG. 2, the inverter 32 assembled in the production section 51 includes a case 28 that houses devices such as power conversion circuits (a converter circuit and an inverter circuit) and radiation fins, and a terminal device 20 exposed from the case 28.

The terminal device 20 includes eight terminal portions, and serves to subject three-phase alternating currents input from three (three-phase) input terminal portions 14A to power conversion and to output three-phase alternating currents having changed frequencies and voltages from three (three-phase) output terminal portions 14B. Besides the input terminal portions 14A and the output terminal portions 14B, the terminal device 20 includes two braking-resistor connecting terminal portions 14C.

The braking-resistor connecting terminal portions 14C are terminals connected to an internal braking resistor, and assist in braking of a motor connected to the inverter 32 by causing the braking resistor to consume regenerative energy of the motor.

While the terminal device 20 is exposed out from the inverter 32 in the product test section 52, an upper case 21 (see FIG. 5) is attached in the product test section 52. Thus, the devices that constitute the inverter 32, including the terminal device 20, are covered with the upper case 21 and the case 28.

Terminal Device

Figure 3:
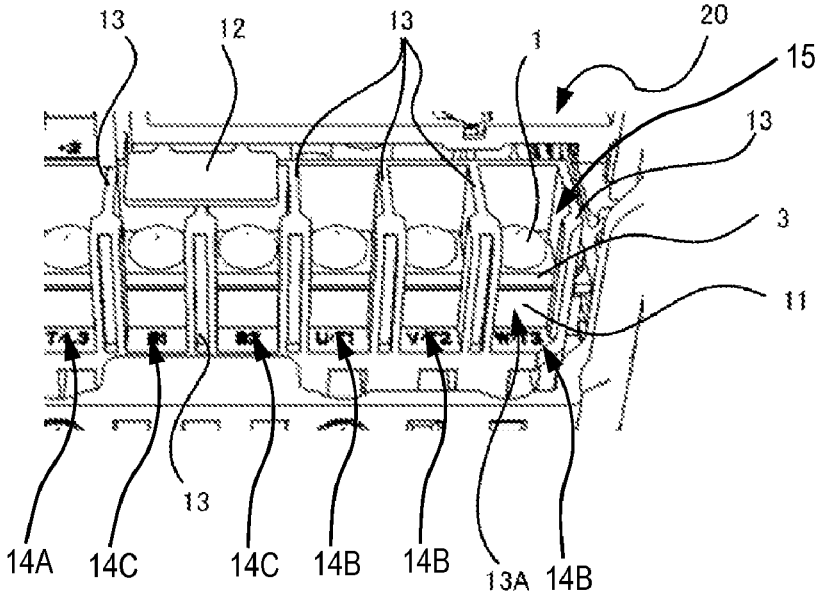
FIG. 3 is an enlarged view of the terminal bases in the inverter.

As illustrated in FIG. 3, the input terminal portions 14A, the output terminal portions 14B, and the braking-resistor connecting terminal portions 14C are separated by partition walls 13 formed of an insulating material.

A miswiring prevention cover 12 formed of an insulating material is attached above the braking-resistor connecting terminal portions 14C.

The function of the miswiring prevention cover 12 will be described. To use the inverter 32, the user needs to insert terminals of an external device to be connected, from an opening above the partition walls 13 and to hold the terminals of the external device by terminal screws 1, washers 3, and L-shaped terminal bases 11, as will be described below. However, since it is conceivable that the braking-resistor connecting terminal portions 14C are less frequently used than the input terminal portions 14A and the output terminal portions 14B, the terminals of the external device, which should be connected to the input terminal portions 14A or the output terminal portions 14B, may be erroneously connected to the braking-resistor connecting terminal portions 14C. The miswiring prevention cover 12 prevents such miswiring.

The input terminal portions 14A, the output terminal portions 14B, and the braking-resistor connecting terminal portions 14C have similar structures.

As illustrated in FIG. 3, each of the terminal portions is surrounded on three sides by the partition walls 13. One side of the terminal portion is not covered, thereby forming an open portion 13A. On inner sides of the partition walls 13, a terminal holding mechanism 15 including a terminal screw 1, a washer 3, and an L-shaped terminal base 11 is provided.

That is, the terminal screw 1, the washer 3, and the L-shaped terminal base 11 are each formed of a conductor such as to achieve electrical connection to an electric circuit in the inverter 32. Electrical connection can be made by contacting a conductor with the L-shaped terminal base 11.

The open portions 13A of the input terminal portions 14A, the output terminal portions 14B, and the braking-resistor connecting terminals 14C extend in the same direction.

Figure 4:
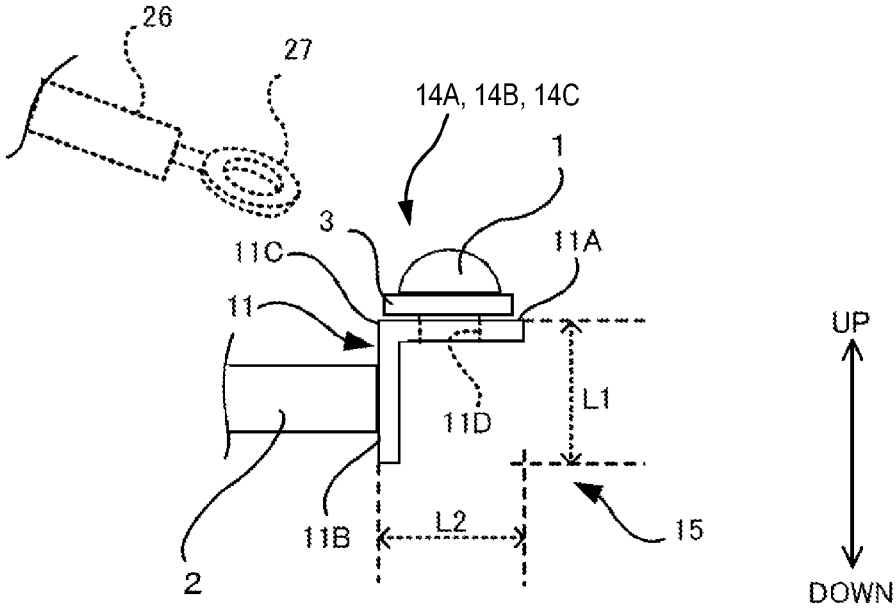
FIG. 4 is a cross-sectional view of a terminal base in the inverter.

As illustrated in FIG. 4, each L-shaped terminal base 11 includes a support surface 11A that supports the washer 3, and a flat contact surface 11B extending in a substantially up-down direction from the support surface 11A via a bent portion 11C bent about 90 degrees. The contact surface 11B directly faces the above-described open portion 13A.

In other words, the L-shaped terminal base 11 is formed so that the direction of the normal to a plane that forms the contact surface 11B is substantially equal to the direction in which the open portion 13A extends.

A length L2 of the support surface 11A and a length L1 of the contact surface 11B in the L-shaped terminal base 11 are substantially equal.

The support surface 11A has a thread groove 11D in which the terminal screw 1 is screwed.

An upper surface of the terminal screw 1 is shaped like a curved surface, and has a groove (not illustrated) to be engaged with a screw jig.

The washer 3 is provided between a head portion of the terminal screw 1 and the L-shaped terminal base 11. The washer 3 and the support surface 11A clamp an external connection terminal 26. For example, the external connection terminal 26 is an appropriate terminal having an annular terminal portion (round terminal), as illustrated in FIG. 4.

The external connection terminal 26 is held by inserting the terminal screw 1 in an annular portion 27 so that the external connection terminal 26 is clamped by the washer 3 and the support surface 11A. Also, the external connection terminal 26 is electrically connected to the electric circuit in the inverter 32.

Configuration of Test Apparatus

Figure 5:
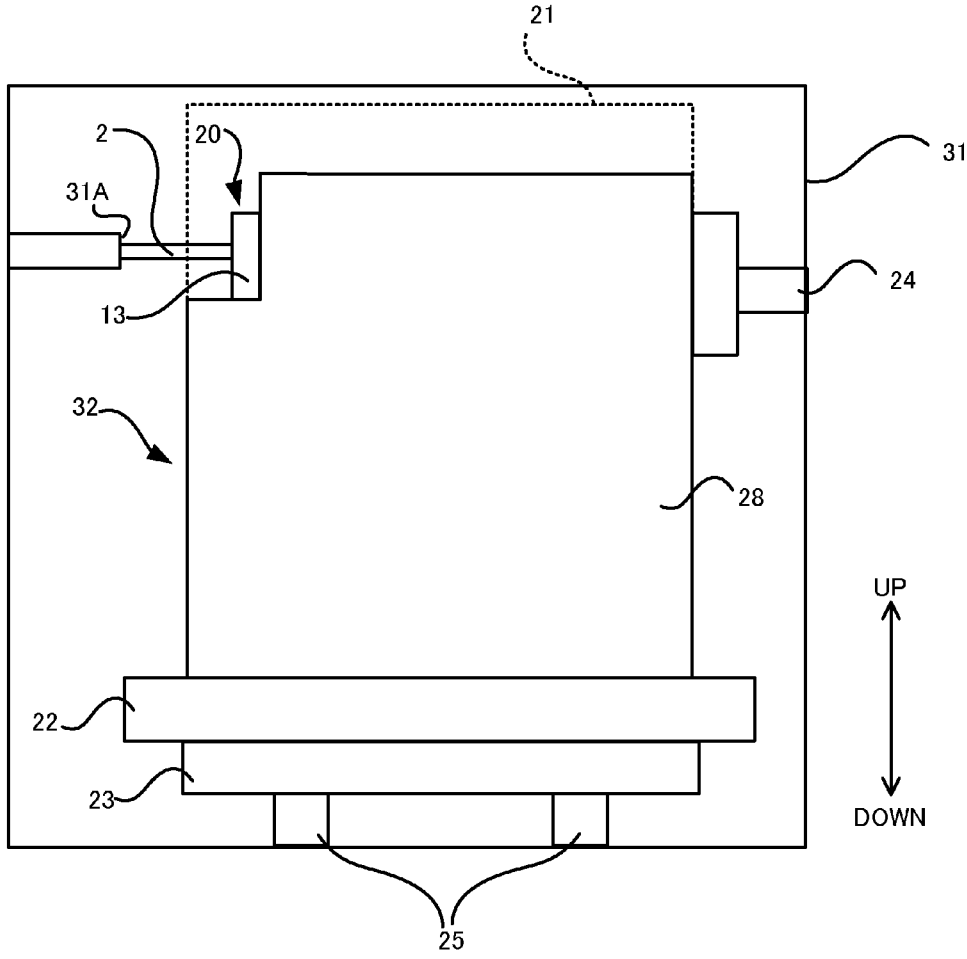
FIG. 5 illustrates a state in which the inverter is connected by an automatic connecting device.

As illustrated in FIG. 5, a test apparatus 31 is provided in the product test section 52. The test apparatus 31 covers the production line 50, and includes eight power supply pins 2, a pallet 22, a pallet lifter 23, a back-surface support member 24, and horizontal conveyor belts 25.

The eight pins 2 are arranged side by side on an inner side wall 31A of the test apparatus 31, and can extend inward and outward in the lateral direction relative to the inner side wall 31A. Further, the pins 2 are connected to a power supply or a test circuit (not illustrated).

The pins 2 are shaped to have a relatively large diameter and to be provided with multiple fine projections at tips thereof. This secures sufficient contact areas between the pins 2 and the contact surfaces 11B, and increases the force for pressing the pins 2 against the contact surfaces 11B. Thus, even if vibration or the like occurs at power-on, undesirable discharging due to slight separation between the pin 2 and the contact surfaces 11B is prevented. Hence, the production test can be conducted more stably.

The pallet 22 is provided with a fixture (not illustrated) on which the inverter 32 on the conveyor is placed and fixed. Further, the pallet 22 is fixed on the pallet lifter 23.

The pallet lifter 23 can move the pallet 22 up and down by an actuator (not illustrated). The pallet lifter 23 is provided on the horizontal conveyor belts 25. The pallet lifter 23 and the horizontal conveyor belts 25 position the pallet 22 according to the model of the inverter 32 so that the terminal device 20 of the inverter 32 opposes the pins 2.

The back-surface support member 24 supports the inverter 32 against the pressing forces of the pins 2 from the opposite side. The position of the back-surface support member 24 can be changed according to the model of the inverter 32. Operations of the pins 2, the pallet lifter 23, and the horizontal conveyor belts 25 are controlled by a controller (not illustrated).

Since the electronic apparatus and the production line 50 for the electronic apparatus according to the embodiment have the above-described configurations, an inverter 32 assembled in the production section 51 is transported into the test apparatus 31 of the product test section 52 by the conveyor.

After being transported into the test apparatus 31, the inverter 32 is fixed to the pallet 22.

Then, the pallet lifter 23 and the horizontal conveyor belts 25 are operated according to model information about the inverter 32 input to the controller beforehand, and the position of the pallet 22 is adjusted so that the pins 2 are aligned with the open portions 13A of the terminal portions 14A to 14C.

After that, the pins 2 extend from the inner side wall 31A, ends of the pins 2 come into contact with the contact surfaces 11B of the L-shaped terminal bases 11, and power for the test is supplied from the input terminals 14A, as illustrated in FIG. 4. The output from the output terminals 14B is input to a test circuit in the test apparatus 31, and a product test is conducted on the inverter 32.

The controller stores the acceptability criterion in the product test. An accepted inverter 32 is covered with an upper case 21 on the downstream side of the product test section 52, and is then packaged.

In this way, according to the embodiment, when the assembled inverter 32, excluding the upper case 21, on the production line is subjected to a product test during production, the protruding pins 2 are brought into contact with the vertical and flat contact surfaces 11B from the side of the inverter 32, whereby the inverter 32 is powered on and connected to the test circuit.

Figure 6:
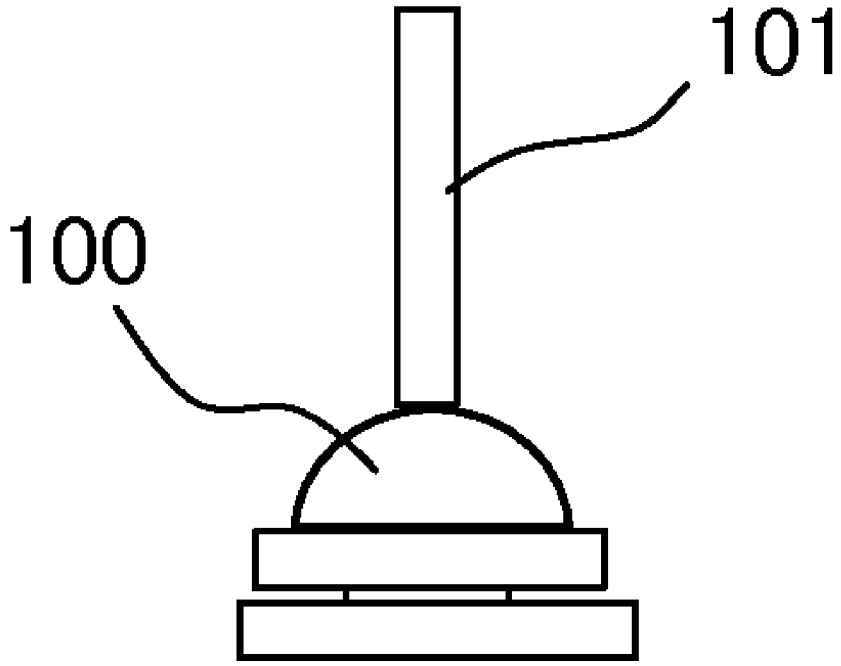
FIG. 6 illustrates an electrical connecting method of the related art for a terminal screw and a pin.

For example, in a case in which a terminal screw head portion 100 shaped like a curved surface contacts a pin 101, if the contact therebetween is insufficient because the contact area is relatively small, as illustrated in FIG. 6, an arc (or a spark) may occur during power supply.

However, according to the embodiment, since the pins 2 contact the flat contact surfaces, discharging (arc discharging) is suppressed, compared with a case in which the pins 2 contact the convex surfaces like the head portions of the screws. Moreover, since the pins 2 need not be brought into contact with the inverter 32 from above, the height of the test apparatus 31 can be reduced.

In addition, since the miswiring prevention cover 12 is provided above the braking-resistor connecting terminal portions 14C, it is possible to prevent the external device terminal, which should be connected to the input terminal portion 14A or the output terminal portion 14B, from being erroneously connected to the braking-resistor connecting terminal 14C. That is, in each of the terminal portions 14A to 14C during normal use, it is necessary to loosen the terminal screw 1 by a screw jig from above and to clamp the external terminal of the power supply or the like between the washer 3 and the L-shaped terminal base 11. However, the braking-resistor connecting terminal portions 14C are less frequently used than the input terminal portions 14A and the output terminal portions 14B. Hence, it is conceivable that the external terminal, which should be connected to the input terminal portion 14A or the output terminal portion 14B, will be erroneously connected to the braking-resistor connecting terminal portion 14C.

In the embodiment, since the pins 2 contact the contact surfaces 11B from the side, not from above, even after the miswiring prevention cover 12 is assembled in the production section 51, the pins 2 are pushed from the side through the open portions 13A without removing the miswiring prevention cover 12 in the product test section 52. This allows the product test to be carried out easily.

While the embodiment of the present invention has been described above, the present invention is not limited to the above-described embodiment. Appropriate modifications can be made without departing from the scope of the invention.

What is claim is:

1. A terminal device comprising:

partition walls defining at least one open portion between the partition walls, each of the partition walls extending along a first direction; and at least one terminal portion configured to conduct power from an external terminal to an electric circuit and provided between the partition walls, the at least one terminal portion comprising:

a terminal base provided to be electrically connected to the electric circuit, the terminal base including a support surface, a contact surface and a fixing hole, the support surface extending along the first direction, the contact surface facing the open portion and extending along a second direction perpendicular to the first direction, the fixing hole being provided in the support surface; and a fixing member to connect the external terminal to the terminal base, the fixing member being fixed to the fixing hole and extending along the second direction.

2. The terminal device according to claim 1, wherein the at least one terminal portion comprises a washer provided between the terminal base and the fixing member, and wherein the support surface is provided to support the washer.

3. The terminal device according to claim 1, wherein the at least one terminal portion includes a plurality of the terminal portions arranged side by side in a third direction perpendicular to the first and second directions, the terminal portions being respectively provided between the partition walls adjacent to each other, and wherein the contact surfaces in the terminal portions are arranged in parallel.

4. The terminal device according to claim 3, wherein the plurality of the terminal portions include input terminal portions to which three-phase power is to be input, output terminal portions configured to output three-phase power, and a braking-resistor connecting terminal portion configured to be connected to a braking resistor provided in the electric circuit, and wherein a miswiring prevention cover is provided above the braking-resistor connecting terminal portion.

5. A terminal device comprising:

a terminal screw formed of a conductive material; and a terminal base including a support surface and a contact surface, the support surface extending along a first direction and having a screw hole with a thread groove corresponding to the terminal screw, the contact surface extending along a second direction perpendicular to the first direction and being provided to be in contact with a power supply portion of a test apparatus, the terminal screw being screwed in the screw hole along the second direction.

6. The terminal device according to claim 5, further comprising:

a washer provided between the terminal screw and the support surface.

7. An electronic apparatus comprising:

an electronic apparatus body having an electric circuit; and a terminal device provided in the electronic apparatus body, wherein the terminal device includes partition walls defining at least one open portion between the partition walls, each of the partition walls extending along a first direction, and at least one terminal portion configured to conduct power from an external terminal to the electric circuit, the at least one terminal portion comprising:

a terminal base provided to be electrically connected to the electric circuit, the terminal base including a support surface, a contact surface and a fixing hole, the support surface extending along the first direction, the contact surface facing the open portion and extending along a second direction perpendicular to the first direction, the fixing hole being provided in the support surface; and a fixing member to connect the external terminal to the terminal base, the fixing member being fixed to the fixing hole and extending along the second direction.

8. An electronic apparatus comprising:

an electronic apparatus body having an electric circuit; and a terminal device provided in the electronic apparatus body, wherein the terminal device includes a terminal screw formed of a conductive material, and a terminal base including a support surface and a contact surface, the support surface extending along a first direction and having a screw hole with a thread groove corresponding to the terminal screw, the contact surface extending along a second direction perpendicular to the first direction and being provided to be in contact with a power supply portion of a test apparatus, the terminal screw being screwed in the screw hole along the second direction.

* * * * *